United States Patent [19]

Wiltrout

[11] 4,328,634

[45] May 11, 1982

[54] LOCK COVER FOR MUZZLE LOADING RIFLES

[76] Inventor: James W. Wiltrout, R.D. #1, Markleton, Pa. 15551

[21] Appl. No.: 166,088

[22] Filed: Jul. 3, 1980

[51] Int. Cl.[3] ..... F41C 27/08

[52] U.S. Cl. ..... 42/1 N

[58] Field of Search ..... 42/1 N, 51, 83

[56] References Cited

U.S. PATENT DOCUMENTS

| | | | |
|---|---|---|---|
| 2,441 | 2/1842 | Griswold | 42/51 |
| 1,515,415 | 11/1924 | Ronningen | 42/1 N |
| 1,861,533 | 6/1932 | Hutchinson | 42/51 |
| 3,757,447 | 9/1973 | Rowe | 42/51 |

*Primary Examiner*—Charles T. Jordan

*Attorney, Agent, or Firm*—Harvey B. Jacobson

[57] ABSTRACT

An inverted generally channel-shaped member is provided for downward embracing engagement over the stock of a flint lock mechanism equipped muzzle loading rifle having its flint lock mechanism supported from one side of the rifle stock. The channel member includes opposite side depending first and second flanges interconnected by an upper bight portion extending and secured between the upper marginal edges of the side flanges and the bight portion includes an opening in vertical registry with the flint lock mechanism. The bight portion includes an opening formed therein in vertical registry with the flint lock mechanism and a top wall portion is supported from the channel member for swinging movement into and out of closing relation with the opening. When the top wall portion is in the closed position, the flint lock mechanism is at least substantially fully enclosed within the channel member and thus protected from the elements and when the top wall portion is in the open position free access to the flint lock mechanism is provided from above. The opening and top wall portion are spaced to the same side of the longitudinal center line of the rifle on which the flint lock mechanism is disposed.

9 Claims, 8 Drawing Figures

LOCK COVER FOR MUZZLE LOADING RIFLES

BACKGROUND OF THE INVENTION

Hunting with flint lock mechanism equipped long guns is becoming increasingly popular and in many localities special hunting seasons for hunters who use flint lock mechanisms equipped long guns have been established. For this reason, as well as the fact that hunting with a flint lock mechanism equipped long gun is considered to be greater sport than hunting with more conventional and sophisticated weapons, increasing numbers of hunters are turning to flint lock equipped long guns. However, flint lock equipped weapons are highly subject to misfiring during high humidity conditions. Carrying a primed and unprotected flint lock equipped weapon in the rain or snow for any length of time results in a high risk of misfiring and movement through brush after a rain or a snow can result in the flashing powder becoming damp as a result of moisture dropping from trees and brush with the result that misfiring occurs. Accordingly, a need exists for structure whereby the flint lock mechanism of a hunting weapon may be protected against moisture until immediately prior to the weapon being fired.

An example of a flint lock type weapon including some of the general structural features of the instant invention as well as other cover portions for different types of firearms are disclosed in U.S. Pat. Nos. 2,441, 1,861,533 and 3,757,447. However, these previously known devices do not perform the desired functions of the instant invention.

BRIEF DESCRIPTION OF THE INVENTION

The cover of the instant invention is constructed in the form of a downwardly opening channel member which may be downwardly displaced into embracing engagement with at least the opposite side and upper portions of a flint lock mechanism equipped long gun and the channel member includes an upper opening therein for vertical registry with the associated flint lock mechanism and a top wall portion is supported from the channel member for movement into and out of closing relation with the upper opening. When the top wall portion is in the closed position the associated flint lock mechanism is substantially fully enclosed within the channel member and protected from the elements. When the top wall portion is in the open position, free access is afforded to the flint lock mechanism from above.

The main object of this invention is to provide a structure which may be supported from a flint lock mechanism equipped long gun and which will be operative to maintain the flint lock mechanism protected against moisture either from high humidity conditions, rain and/or snow.

Another object of this invention is to provide a cover in accordance with the preceding object and including a shiftable portion thereof which may be moved to an open position providing free access to the associated flint lock mechanism from above without the necessity of removing the cover from the associated long gun.

Still another important object of this invention is to provide a cover including structural features which adapt it for mounting on and effective operative association with different models of flint lock mechanism equipped long guns.

A further object of this invention is to provide a cover constructed in a manner which will not interfere with normal sighting of the associated long gun.

Another important object of this invention is to provide a cover in accordance with the preceding objects and which may be mounted on an associated long gun without the use of fasteners or any modifications being required to the long gun.

Still another important object of this invention is to provide a cover which will also serve to upwardly duct the flash occurring upon firing of the associated long gun whereby the effect of the flash will be directed away from the face of the user of the long gun.

A further object of this invention is to provide a cover in accordance with the preceding objects and which may also function to prevent accidental actuation of the associated flint lock mechanism.

Still another important object is to provide a cover which will also protect the associated flint lock mechanism against accidental impact.

A final object of this invention is to provide a cover in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 4:
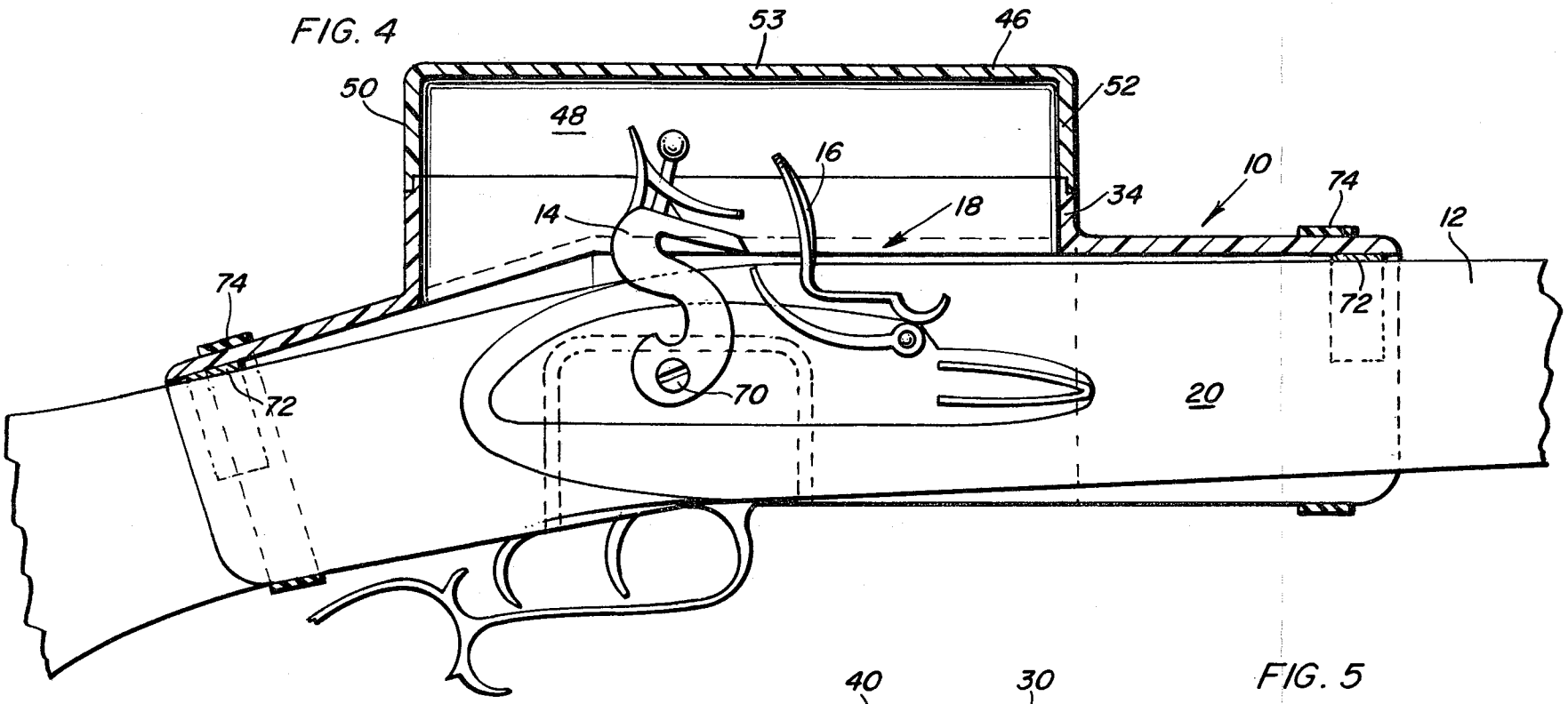
FIG. 4 is a longitudinal vertical sectional view of the cover taken substantially upon a plane passing through the right hand marginal portion of the cover.
Figure 5:
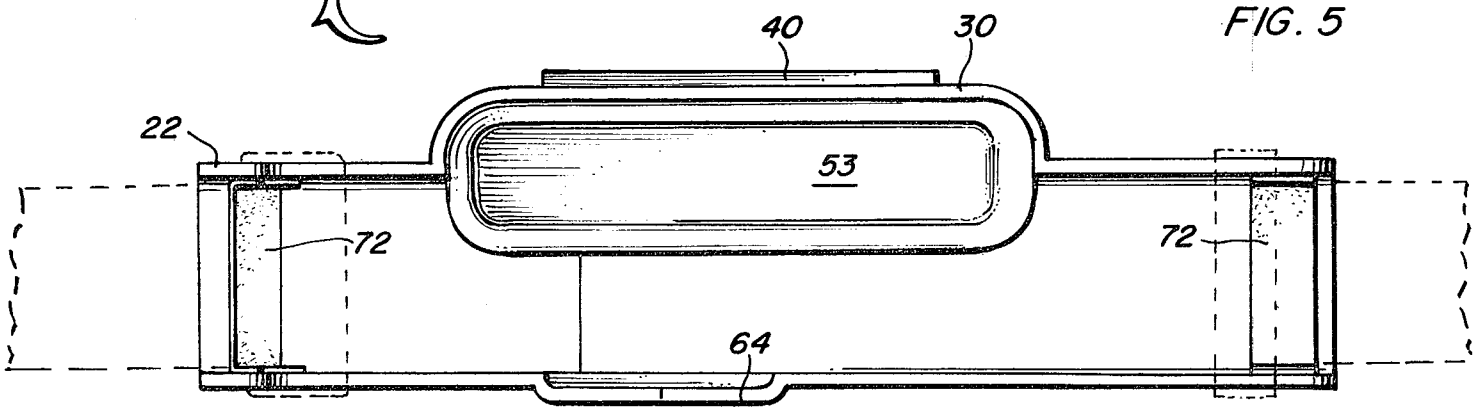
FIG. 5 is a bottom plane view of the cover.
Figure 6:
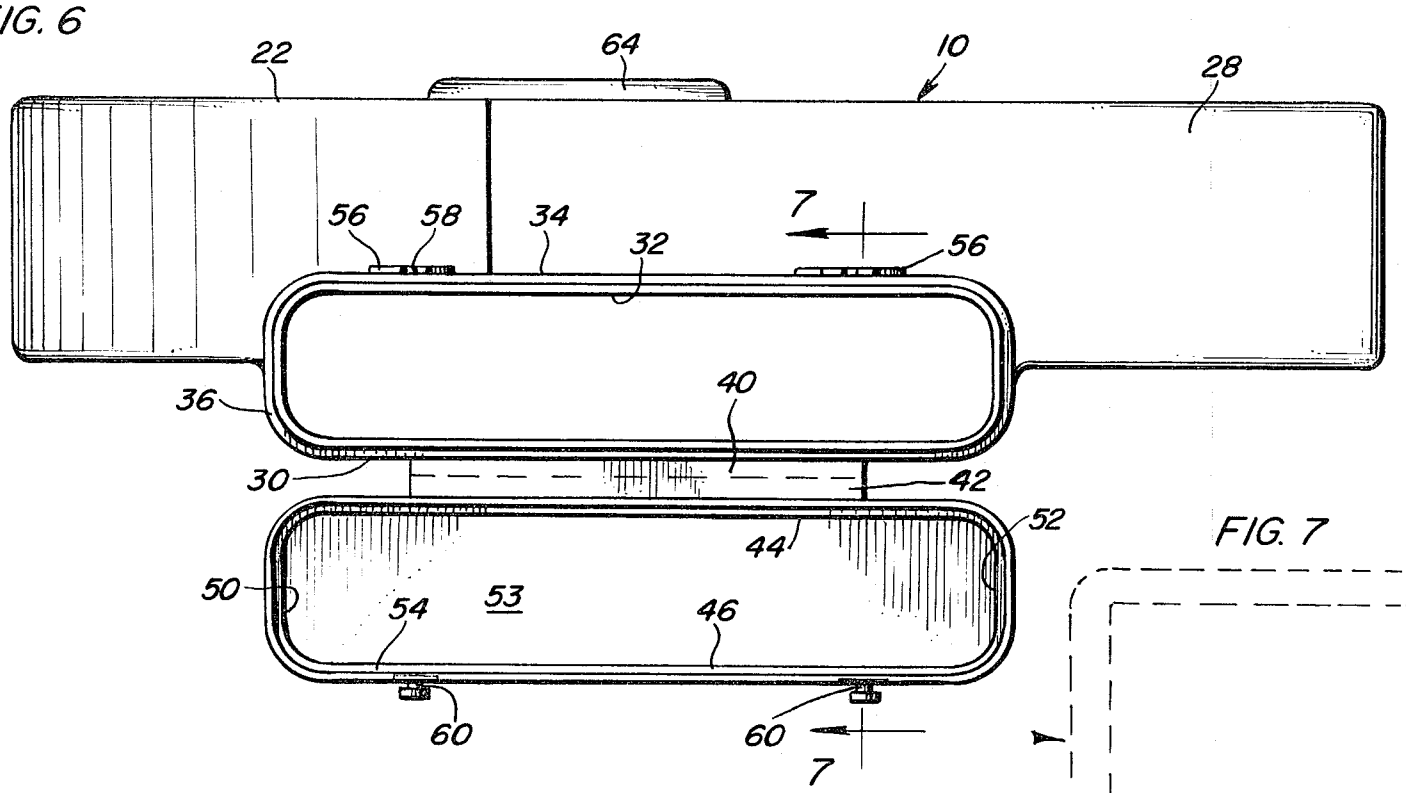
FIG. 6 is a top plane view of the cover with the hinged top wall portion thereof in the open position.

Referring now more specifically to the drawings the numeral 10 generally designates the cover of the instant invention which is illustrated in FIG. 4 in longitudinal vertical section and in operative associated with a flint lock mechanism equipped long gun 12. The flint lock mechanism includes the usual pivotally mounted hammer 14 and frizzen 16. The flint lock mechanism is referred to in general by the reference numeral 18 and is disposed on the right hand side of the stock 20 of the rifle 12.

The cover 10 includes an elongated inverted generally U-shaped channel member 22 including opposite side depending flanges 24 and 26 interconnected along their upper marginal portions by a bight portion 28 extending and secured therebetween. The longitudinal mid-portion of the side flange 24 includes a laterally outwardly offset portion 30 and the bight portion 28 defines an opening 32 therein and an upstanding curb 34 extending about the sides of the opening 32 remote from the portion 30 with the ends of the curb 34 merging smoothly into the opposite ends of the laterally outwardly offset portion 30.

It will be noted, accordingly, that the opening 32 comprises a vertical opening extending downwardly through the right hand side of the channel member 22. The upper marginal portions of the curb 34 and the laterally outwardly offset portion 30 are horizontally aligned and equipped with an outer side step 36.

Figure 1:
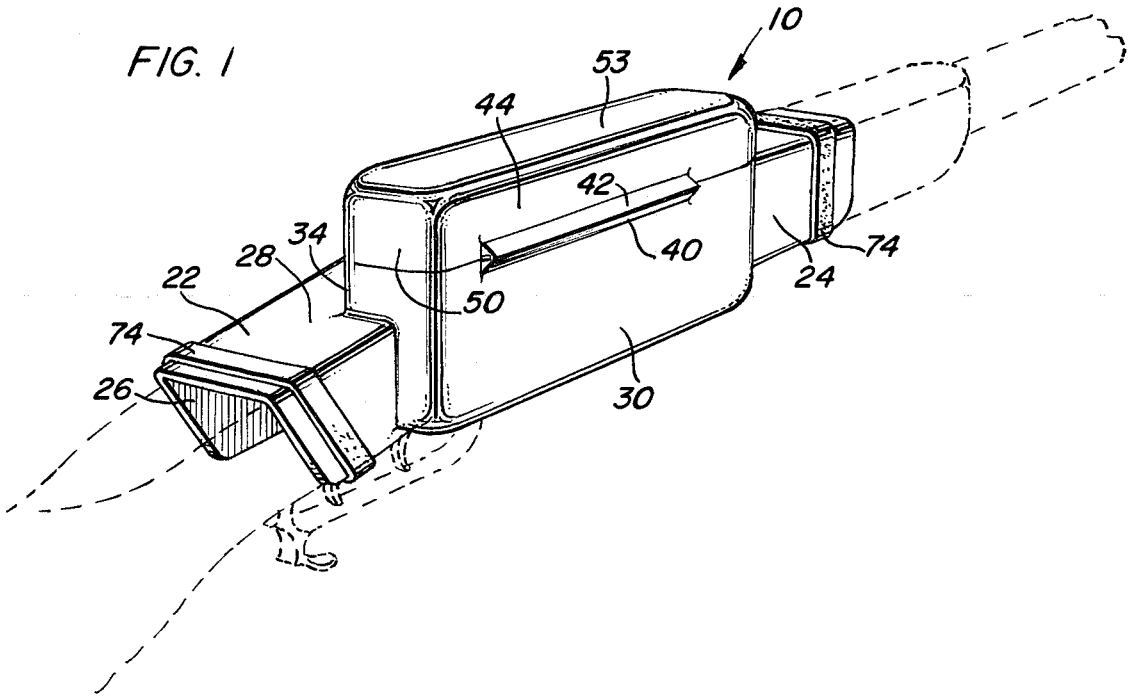
FIG. 1 is a perspective view of the cover as seen from the rear right hand corner.
Figure 2:
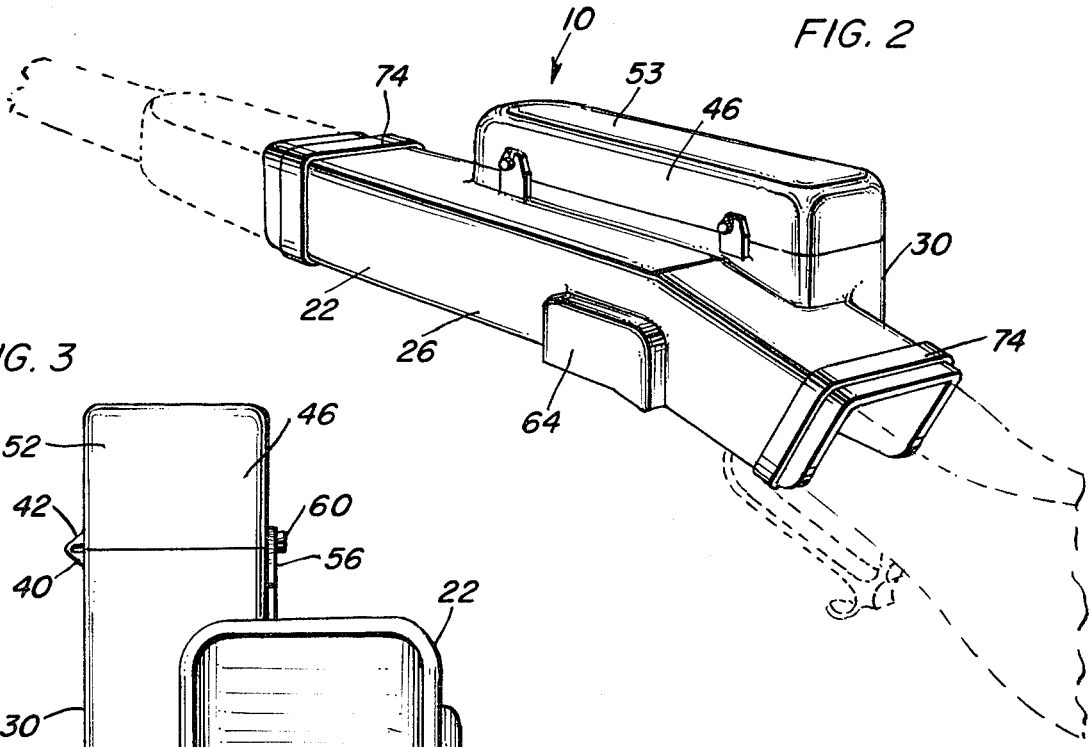
FIG. 2 is a perspective view of the cover as seen from the rear left hand corner.
Figure 3:
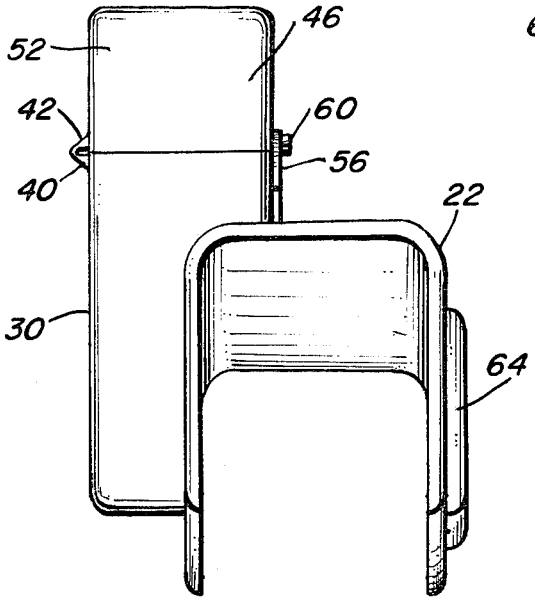
FIG. 3 is a front elevational view of the cover on somewhat of an enlarged scale.

The channel member 22 is downwardly telescoped over and embracingly engaged with the rifle 12 in the manner illustrated in FIGS. 1, 2 and 4 of the drawings and it will be noted that the opening 32 is in vertical registry with the flint lock mechanism 18. The upper marginal portion of the laterally outwardly offset portion 30 includes an integral portion 40 defining a first portion of a "living hinge" and a second corresponding portion 42 of the "living hinge" is supported from one longitudinal wall portion 44 of a downwardly opening top wall portion 46 hingedly supported from the remainder of the cover 10. The top wall portion 46 includes a second longitudinal wall portion 48 opposite the wall portion 44 and opposite end wall portions 50 and 52. The wall portions 44, 48, 50 and 52 are interconnected by an integral top wall 53 extending therebetween. Accordingly, it may be seen that the top wall portion 46 defines a hollow downwardly opening cover and it will be noted that the free marginal edges of the wall portions 44, 48, 50 and 52 remote from the top wall 53 include a continuously peripheral inner side step 54 which mates and interengages with outer side step 36 in order that the top wall portion 46 may close the opening 32 from above in a substantially water tight manner.

Figure 7:
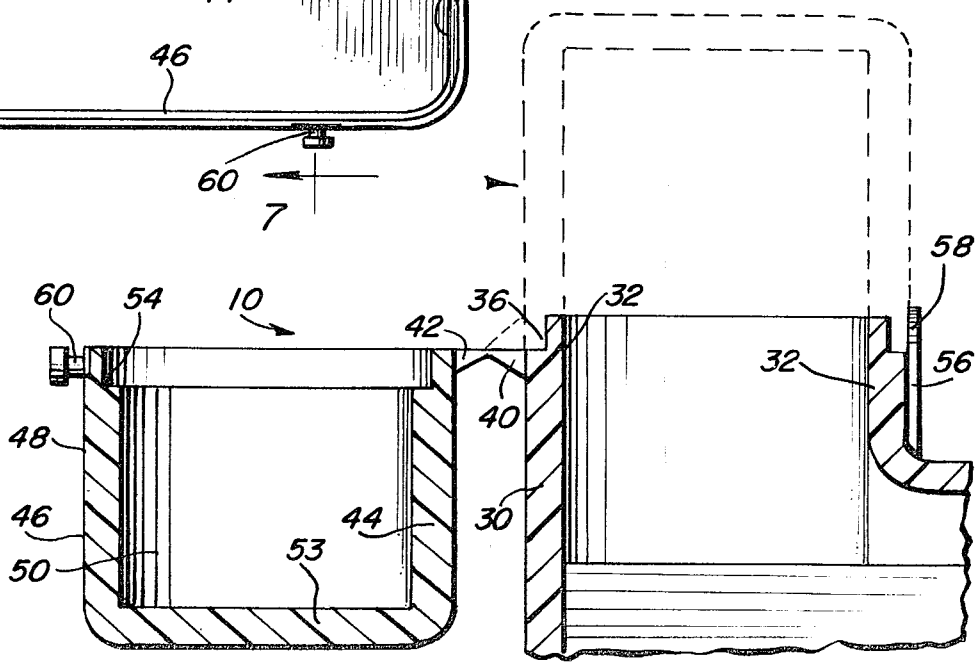
FIG. 7 is an enlarged fragmentary transverse vertical sectional view taken substantially upon the plane indicated by the section line 7—7 of FIG. 6.
Figure 8:
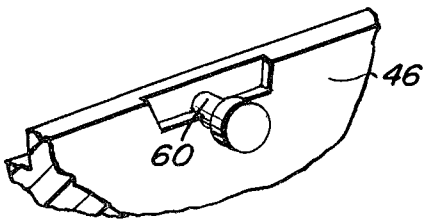
FIG. 8 is a fragmentary perspective view illustrating one of the swingable top wall portion latches.

The portion of the curb 34 remote from the outwardly offset portion 30 includes a pair of integral upwardly directed latching flanges 56 including upwardly opening notches 58 formed therein and the free marginal edge of the longitudinal wall portion 48 includes a pair of longitudinally spaced outstanding and headed studs 60 releasably engageable with the flanges 56 with the studs 60 received in the notches 58 in order to releasably latch the top wall portion in the closed phantom line position thereof illustrated in FIG. 7.

The portion of the side flange 26 remote from the outwardly offset portion 30 of the side flange 24 includes a laterally outwardly offset portion 64 to define a shallow inwardly opening recess 66 for receiving the corresponding end of the lock screw 70 and the inner surfaces of the opposite ends of the channel member 22 include adhesively backed seal strips 72 mounted therein and engageable with the upper and opposite side surfaces of the stock 20 in order to prevent the entrance of moisture into the opposite ends of the channel member 22.

A pair of elastic bands 74 or similar structures may be utilized to releasably secure the cover 10 in operative position on the stock 20 of the rifle 12 and it will be readily apparent from the drawings that when the top wall portion 46 is in the open position ready access to the flint lock mechanism 18 may be had from above. However, once the rifle 12 has been loaded and is primed for firing, the top wall portion 46 is swung to and latched in the closed position thereof illustrated in FIGS. 1, 2 and 4 of the drawings. Thus, the flint lock mechanism 18 is protected against moisture. Immediately prior to firing the rifle, the top wall portion 46 is opened and the flash resulting from firing the rifle 12 will be directed upwardly and away from the face of the user of the rifle 12. Also, immediately subsequent to the firing of the rifle 12 it may be reloaded in the conventional manner.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a stock equipped flint lock mechanism rifle having its flint lock mechanism supported from one side of the rifle stock, an enclosure for said mechanism, said enclosure including a downwardly opening cover supported from said rifle in position enclosing said mechanism from above and including a top wall portion spaced above said mechanism, means supporting said top wall portion from the remainder of said cover for displacement relative to said remainder of said cover to an out-of-the-way position providing ready access to said mechanism from above.

2. The combination of claim 1 wherein said means supporting said top wall portion from the remainder of said cover comprises hinge means swingably supporting said top wall portion from said cover for swinging movement of said top wall portion relative to said cover between a closed position overlying said mechanism and closing said opening and an out-of-the-way position disposed to the side of said cover corresponding to said one side of said stock.

3. The combination of claim 2 wherein said top wall portion and remainder of said cover are constructed of plastic and said hinge means includes an integral plastic "living hinge".

4. The combination of claim 1 wherein said cover includes an inverted generally channel shaped member downwardly embracingly engaged over said stock and including opposite side depending first and second flanges disposed outwardly of said one side of said stock and the other side of said stock, respectively, and an upper bight portion extending and connected between the upper marginal portions of said flanges, said one side flange including a laterally outwardly offset portion intermediate its opposite ends, said bight portion, adjacent said one side flange, having an opening formed therein in lateral registry with said outwardly offset one side flange portion, extending vertically through said bight portion and opening laterally toward said outwardly offset portion, said top wall being supported from the remainder of said cover for displacement into and out of position closing said opening from above.

5. The combination of claim 4 wherein said opening is spaced to the side of the longitudinal center line of said channel shaped member corresponding to said one side of said stock.

6. The combination of claim 5 wherein said laterally outwardly offset portion extends upwardly above said bight portion and the latter includes an upwardly extending curb extending about said opening and including opposite ends integral with said laterally offset portion, said top wall being operative to close said opening along the upper edges of said curb and said outwardly offset portion.

7. In combination with a stock equipped lock mechanism rifle having its flint lock mechanism supported from one side of the rifle stock, an elongated cover portion laterally engaged with said stock and enclosing said mechanism from above, said cover defining a vertical opening therethrough registered with said mechanism, said cover including a top wall portion supported from said cover over said mechanism and in position closing said opening from above, said top wall portion being supported from said cover for displacement relative thereto toward an out-of-the-way position exposing said opening from above.

8. The combination of claim 7 wherein said rifle defines a longitudinal center line, said opening and top wall portion being spaced from said center line to the side thereof corresponding to said one side of said stock.

9. The combination of claim 8 wherein said means supporting said top wall portion from the remainder of said cover comprises hinge means swingably supporting said top wall portion from said cover for swinging movement of said top wall portion relative to said cover between a closed position overlying said mechanism and closing said opening and an out-of-the-way position disposed to the side of said cover corresponding to said one side of said stock.

* * * * *